US005531025A

United States Patent [19]

Albone

[11] Patent Number: 5,531,025

[45] Date of Patent: Jul. 2, 1996

[54] NAIL CLIPPER WITH INDEX FINGER HOLDER

[76] Inventor: Norman W. Albone, 15525 Meknes St., San Diego, Calif. 92129

[21] Appl. No.: 240,180

[22] Filed: May 9, 1994

[51] Int. Cl.[6] ..... A45D 29/02

[52] U.S. Cl. ..... 30/28; 30/298; 132/75.5

[58] Field of Search ..... 132/73.5, 75.4, 132/75.5; 30/26, 28, 298

[56] References Cited

U.S. PATENT DOCUMENTS

| | | | |
|---|---|---|---|
| Re. 26,344 | 2/1968 | Reswick | 132/75.5 X |
| D. 266,480 | 10/1982 | Reel | D8/40 |
| 3,997,966 | 12/1976 | Sartore | 30/28 |
| 4,196,514 | 4/1980 | Merriman | 30/28 |
| 4,788,768 | 12/1988 | Ohori | 30/28 |
| 5,046,381 | 9/1991 | Mueller | 30/298 |
| 5,384,960 | 1/1995 | Tottenham | 30/28 |

*Primary Examiner*—John G. Weiss

*Attorney, Agent, or Firm*—John J. Murphey; Murphey Law Offices

[57] ABSTRACT

The invention is a nail clipper that is made up of a pair of upper and lower co-extensive, yieldingly-resilient and cooperatively-opposed members having correspondingly-mated inward and outward end portions, the outward end portions of the members superimposed upon each other and fixedly joined together, the inward ends spring biased and spaced-apart in divergent relationship and including transverse confronting jaws with mating primary cutting blades of requisite curvature and clipping ability, a lever extending angularly upward from a pivotal mounting at a divergent portion of the legs and including a cam-like surface for angular movement with the lever thereabout to squeeze the blades together in a clipping action when the lever is rotated toward the joined ends of the legs, and an index finger end piece attached to the members at the fixed junction for receipt of the distal phalange of the user's index finger therein to operatively support the clipper between the thumb and the end of the forefinger in a pincer-like position.

16 Claims, 1 Drawing Sheet

NAIL CLIPPER WITH INDEX FINGER HOLDER

BACKGROUND OF THE INVENTION

1. Field of the Invention

This invention pertains to the field of personal grooming devices. More particularly, it pertains to nail clippers and to a novel attachment thereto for making their use easier and more accurate.

2. Description of the Prior Art

Humans possess a flattened, elastic structure of a horny texture located on the dorsal surface of the terminal phalanges of the fingers and toes, commonly referred to as "nails". While nature may have historically held nails to some important capacity, modernly, they are the subject of personal grooming and, at the very least, must be kept trimmed to a reasonable length. Often women adorn them with paints of different colors and/or mount sparkling jewelry on them to attract men.

Nail trimming can be accomplished with a wide variety of implements, from the disgusting habit of biting them to the humorous practice of clipping them with large shears, such as done by L'il Abner, a cartoon character of historical fame. For many years, the bulk of nail trimming has been done with the use of what is known as nail clippers.

Nail clippers are most frequently held between the thumb and the phalange of the second row of the index finger and squeezed together to trim the anterior extremity or free edge of the nail. While they are held at a right angle to the phalange of the second row of the index finger, the divergent ends are squeezed together to bring the cutting blades against the nail from above and below. While most adults can operate clippers in this manner, using the phalange of the second row of the index finger brings about a certain amount of instability in that neither the thumb nor the index finger holds the clippers in a fixed direction so that it tends to flop about. With older children and most adults, some stability is achieved by temporarily pressing the jaws of the clippers against the end of the finger, adjacent the nail to be trimmed, to provide three-point, more stable, three-point positioning. However, with infants and in unsettling environments, such as in a moving car or boat, the clippers cannot be held with sufficient stability to accurately trim one's nails. The result may be a poorly trimmed nail or a cut in the skin at the tip of the finger.

The prior art has attempted to provide stability to the common nail clippers by adding refinements to the ends of the clippers, such as shown in U.S. Pat. Nos. 3,744,131; 3,997,996; 5,052,416 and U.S. Pat. No. Des. 266,480. Other changes are added in the area of the cutting blades, such as shown in U.S. Pat. No. 4,196,514. For the most part, these inventions utilize elements that require the clippers to continue to be held between the thumb and the phalange of the second row of the index finger with the phalange and the thumb at a right angle to each other so that the overall posture of the user's hand is still a right angle between the axis of the thumb and the axis of the phalange of the second row of the index finger. In this posture, the nail clippers still tend to move or drift out of position and must still be balanced against the nail for best results.

SUMMARY OF THE INVENTION

This invention is a finger piece attached to the rear end of the nail clippers to position the third row or distal phalange of the index finger therein to eliminate the conventional right angle arrangement between the axis of the thumb and index finger. Using this invention, the clippers will then be held between the ends of the thumb and index finger while they are in substantial parallel, pincer-like position. In one embodiment, the distal phalange of the index finger is fixedly captured in the finger piece to make the whole assembly pivotally inflexible. This provides the greatest accuracy for nail clipping. In another embodiment, the finger piece is pivotally attached to the nail clipper to allow a certain amount of rotation of the index finger during use. This provides improved retaining of the clippers during use. Overall, with this invention, the nail clippers are converted from a tool held between the thumb and phalange of the second row of the index finger to one captured between the thumb and distal phalange of the index finger in a pincer-like manner to provide greatly improved stability and accuracy and to eliminate the need to balance the clippers against the end of the finger whose nail is to be clipped.

Accordingly, the main object of this invention is a nail clipper requiring a grasp between the thumb and the distal phalange of the index finger by providing an index finger end piece at the rear of the clipper. Other objects include a nail clipper whose accuracy is improved by changing the position of the index finger, during use thereof, from a right angle with the thumb to a substantially pincer-like position therebetween; a nail clipper that does not need to be pressed or balanced against the end of the finger whose nail is to be cut but merely pointed thereagainst without further contact; a nail clipper whose grasp is made more positive to provide greater stability during use; a nail clipper that may be used to clip the nails of an infant without the danger of catching the child's skin between the cutting blades; and, a nail clipper with improved stability during use by persons having a lesser degree of dexterity with their fingers and thumbs.

These and other objects of the invention may be observed by reading the following description of the preferred embodiment in conjunction with the drawings appended hereto. The scope of protection sought by the inventor may be gleaned from a close reading of the Claims that conclude this specification.

DESCRIPTION OF THE PREFERRED EMBODIMENT

Figure 1:
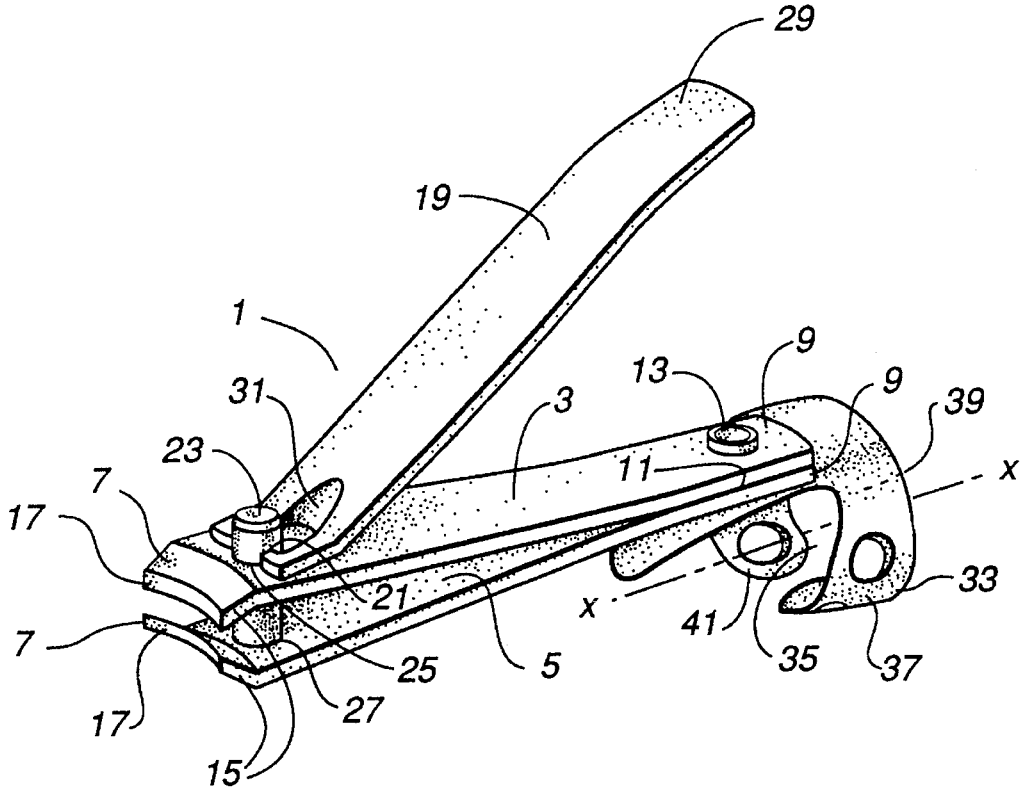
FIG. 1 is a trimetric view of the preferred embodiment of this invention; and, FIGS. 2*a*–2*d* are illustrative views of various embodiments of finger pieces usable in this invention.
Figure 2A:
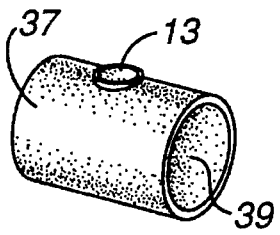
Figure 2B:
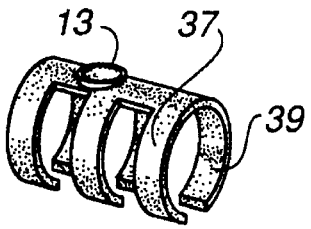
Figure 2C:
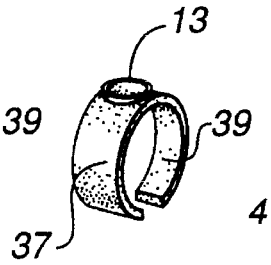
Figure 2D:
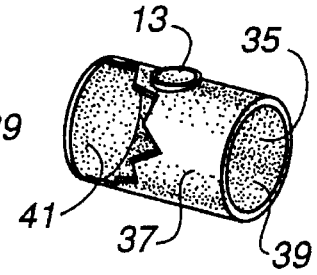

Referring to the drawings where like elements are identified with like numerals throughout the five figures, FIG. 1 shows the general type of nail clippers to which this invention may be applied. Nail clippers 1 are shown to comprise an upper member 3 and a lower member 5 coextensive in length with each other, in cooperatively opposed and superimposed position, having correspondingly mated inward end portions 7 and spaced-apart outward end portions 9 wherein said outward end portions 9 are fixedly joined together at 11 by a rivet 13 or other known means. Members 3 and 5 are yieldingly resilient and made from spring-type material such as chrome-plated or nickle silver plated stainless steel and the like.

Inward end portions 7 are spring-biased, by the original bend applied to either or both members, and spaced-apart in divergent relationship. They include transverse confronting jaws 15 with mating primary cutting blades 17 of requisite curvature and clipping ability.

A lever 19 is pivotally retained in a notch 21 formed in a stud 23 that is loosely retained in a pair of aligned apertures 25 and 27, formed in members 3 and 5 respectively, at a divergent portion of members 3 and 5, and extends angularly upward from a divergent portion of said members to a thumb rest 29 located at the distal end thereof. A cam-like surface 31 is formed on lever 19 and bears against upper member 3 for rotating with lever 19 and squeezing said members and cutting blades 17 together in a clipping action when said lever is angularly pivoted downward, by thumb pressure, toward member junction 11.

An index or forefinger piece 33 is attached to said fixed end junction 11 of members 3 and 5 for housing the distal end or third row phalange of the index finger. Piece 33 is preferably attached to said end junction 11 on the opposite side thereof from lever 19 to allow for the maximum angular movement therebetween. As shown in FIG. 1, finger piece 33 is a capsular body having a cavity 35 and an outer wall 37. In use, the axis x-x of end piece 33 is essentially parallel to the plane formed by the central axis of members 3 and 5 so that the forefinger and thumb are generally in a pincer-like position when holding clippers 1 in operable position. By this means, clippers 1 may be pointed to a finger or toe nail and used in clipping fashion while fully controlled by said finger and thumb, thereby eliminating the need to balance the clipper against the finger or toe whose nail is to be clipped.

FIG. 2 shows a number of different embodiments of finger piece 33 that are usable herein. In the embodiment shown in FIG. 2*d*, an end wall 41, closing cavity 35, spaced inward from said entrance 39, is provided against which the finger may be abutted to provide greater stability during use of the clippers. Finger piece 33 may be rigidly attached to junction 11 or be pivotally attached such as at rivet 13. As shown in FIGS. 2*b* and 2*c*, piece 33 may have open, resilient walls 41 in place of outer wall 37 to provide a firmer grasp to the end of the index finger and greater stability to the clippers. Piece 33 is preferably made from the same material from which members 3 and 5 are made to provide for a sturdy and long lasting device.

While the invention has been described by reference to a particular embodiment thereof, those skilled in the art will be able to make various modifications to the described embodiment of the invention without departing from the true spirit and scope thereof. It is intended that all combinations of elements and steps which perform substantially the same function in substantially the same way to achieve the same results are within the scope of this invention.

What is claimed is:

1. A nail clipper comprising:

a) a pair of upper and lower co-extensive, yieldingly-resilient and cooperatively-opposed members having correspondingly-mated inward and outward end portions;

b) said outward end portions of said members superimposed upon each other and fixedly joined together;

c) said inward ends spring biased and spaced-apart in divergent relationship and including transverse confronting jaws with mating primary cutting blades of requisite curvature and clipping ability;

d) a lever extending angularly upward from a pivotal mounting at a divergent portion of said members and including a cam-like surface for angular movement with said lever thereabout to squeeze said blades together in a clipping action when said lever is rotated toward said joined ends of said members; and, e) a capsular index finger end piece attached to said members at said fixed junction for insertion and housing of the distal phalange of the user's index finger in fixed receipt therein to operatively support said clipper between the thumb and the end of the forefinger in a pincer-like position.

2. The nail clipper of claim 1 wherein said fixed junction is riveted.

3. The nail clipper of claim 1 wherein said spring bias is provided by bends originally formed in both said members.

4. The nail clipper of claim 1 wherein said spring bias is provided by a bend originally formed in said upper member.

5. The nail clipper of claim 1 wherein said lever includes a thumb rest.

6. The nail clipper of claim 1 wherein said pivotal mounting of said lever includes a stud loosely retained in a pair of aligned apertures formed in said members, at a divergent portion thereof, said stud having a notch formed therein in which said lever is retained.

7. The nail clipper of claim 6 wherein said lever extends above said upper member and terminates above said fixed junction of said members.

8. The nail clipper of claim 1 wherein said index finger end piece is affixed to said junction below said members.

9. The nail clipper of claim 1 wherein said index finger capsular end piece is pivotally attached to said junction.

10. The nail clipper of claim 9 wherein said capsular body comprises an outer wall and having formed therein a cavity including a front entrance way, for receipt of the end of the index finger therein.

11. The nail clipper of claim 10 further including an end wall spaced inward from said entrance way against which the finger may be abutted for providing greater stability to the clipper.

12. The nail clipper of claim 1 wherein said index finger end piece is rigidly attached to said fixed junction of said members.

13. The nail clipper of claim 1 wherein said index finger end piece includes resilient walls for surrounding the end of the index finger to firmly grasp said finger therein.

14. A nail clipper comprising:

a) a pair of upper and lower co-extensive, yieldingly-resilient and cooperatively-opposed members having correspondingly-mated inward and outward end portions;

b) said outward end portions of said members superimposed upon each other and fixedly joined together;

c) said inward ends spring biased and spaced-apart, provided by a bend originally formed in said upper member, in divergent relationship and including transverse confronting jaws with mating primary cutting blades of requisite curvature and clipping ability;

d) a lever, including a thumb rest formed at the distal end thereof, extending angularly upward from a pivotal mounting at a divergent portion of said members and including a cam-like surface for angular movement with said lever thereabout to squeeze said blades together in a clipping action when said lever is rotated toward said joined ends of said members;

e) said pivotal mounting including a stud loosely retained in a pair of aligned apertures formed in said members at a divergent portion thereof, said stud having a notch formed therein in which said lever is retained; and, f) a capsular index finger end piece pivotally attached below said members, at said fixed junction therebetween, for insertion and housing of the distal phalange of the user's index finger in fixed receipt therein to operatively support said clipper between the thumb and the end of the forefinger in a pincer-like position, said index finger end piece including resilient walls for surrounding the end of the index finger to firmly grasp said finger therein.

15. The nail clippers of claim 14 wherein said capsular index finger end piece includes open resilient walls to provide a firmer grasp to the end of the index finger and greater stability to the clippers.

16. The nail clippers of claim 14 wherein said capsular index finger end piece forms a cavity therein and an entrance thereinto, for receipt of the tip of the index finger therein, and further includes an end wall, closing said cavity and spaced inward from said entrance against which the finger may be abutted to provide greater stability during use of the clippers.

* * * * *